United States Patent [19]

Ricard et al.

[11] 4,450,707

[45] May 29, 1984

[54] HARDENED METAL WORKPIECE STRAIGHTENING MACHINE

[75] Inventors: Paul R. Ricard; Charles Goclowski, both of Monroe, Conn.

[73] Assignee: Arrow Machine, Inc., Monroe, Conn.

[21] Appl. No.: 387,821

[22] Filed: Jun. 14, 1982

[51] Int. Cl.[3] ..... B21D 3/10

[52] U.S. Cl. ..... 72/389

[58] Field of Search ..... 72/389, 386, 441, 453.01, 72/437

[56] References Cited

U.S. PATENT DOCUMENTS

| | | | |
|---|---|---|---|
| 1,840,237 | 1/1932 | Leighton | 72/389 |
| 2,426,411 | 8/1947 | Peterson | 72/441 |
| 2,486,844 | 11/1949 | Hercik | 72/453.11 |
| 2,726,703 | 12/1955 | Fultz | 72/386 |
| 3,949,588 | 4/1976 | Seo | 72/389 |
| 3,986,380 | 10/1976 | Biggs | 72/76 |
| 4,154,073 | 5/1979 | Galdabini | 72/389 |
| 4,226,111 | 10/1980 | Wahli | 72/437 |
| 4,306,435 | 12/1981 | Galdabini | 72/389 |

*Primary Examiner*—Gene P. Crosby

*Attorney, Agent, or Firm*—Laff, Whitesel, Conte & Saret

[57] ABSTRACT

An apparatus and method for straightening the curvature of a hardened metal workpiece. A relatively sharp chisel point peen is driven by an air hammer to repeatedly strike the surface of the workpiece held on a rigid support table until the workpiece is straightened. The force or frequency of the peen chisel strikes can be infinitely varied by controlling the amount of air pressure delivered to the air hammer. Measurement of the workpiece is accomplished on the worktable by extending the workpiece between a pair of V-blocks and beneath a plurality of dial indicators.

5 Claims, 4 Drawing Figures

HARDENED METAL WORKPIECE STRAIGHTENING MACHINE

FIELD OF THE INVENTION

This invention relates to a method and an apparatus for straightening and inspecting hardened metal material that has no or very little ductility. More particularly, the present invention relates to a reciprocating, variable force, chisel-pointed peening head which is adapted to repeatedly work a piece of hard metal to straighten the curvature in the metal piece which may have resulted from internal stresses of the material developed through heat treatment, milling, grinding, or other metal working processes.

BACKGROUND OF THE INVENTION

The manufacture of certain tool steel products such as drills, reamers, broaches and the like involves fabricating such tools from hardened metal material which have little or no ductility. These materials are normally subject to heat treatment processes to obtain the desired hardness. During the heat treatment process, internal stresses are developed in the material which tend to produce an undesirable curvature in the material. In addition, certain metal working processes, such as grinding, milling, planeing and the like, also result in producing a curvature in the metal. It is virtually impossible to maintain the straightness of tool steels during the heat treatment process.

Several methods of re-working curved metal to straighten the material are currently available. These include: (1) bending the metal in a vise or suitable press with adjustable controls during cooling of the metal following heat treatment, and continuing to just above the maximum stress limit; (2) placing the curved metal piece between a pair of V-blocks or centers and applying pressure on the high side below the elastic limit and applying heat from a torch leaving the part in place until the heat is dissipated; (3) peening by hand or by mechanical means by striking the inner curvature of the deformed part, thereby causing the part to straighten.

The above-mentioned heating processes have the disadvantage of causing the material to lose its hardness. Also, great skill is required to produce satisfactory results using these processes. Bending the metal in a vise also requires great skill to obtain the proper objective.

Penning by hand or other mechanical means can result in destruction of the material due to excessive working, such as tears or breakage. Therefore, these operations also require great skill or machines of utmost precision.

The present invention provides a peening-type straightening method and apparatus which duplicates hand-type peening processes, which straightens curved metal faster, and is easy to operate. In addition, the present invention utilizes a pointed, chisel-type peening head which will not leave marks or chips in the metal being worked. This leaves very little grinding to clean up the metal after the straightening operation has been completed. Thus, the present invention cannot be applied to soft metal material.

One example of a prior machine used to increase surface hardness and to straighten curved metal is the disclosure in U.S. Pat. No. 4,226,111, which illustrates a reciprocating strike hammer device for applying continuous blows to the metal by means of a strike bolt having a curved or rounded point. The particular device of this disclosure is used to work soft metals, and to increase the surface hardness of these metals by peening. For this purpose, the strike bolt has a rounded point so as not to damage the metal subjected to the peening process. In contrast, the method and apparatus of the present invention is adapted to straighten hardened metals, and a pointed chisel-like tip is used on the peening element. The hardened steel may receive only slight chisel marks, if any, which can be removed by a simple grinding process. In addition, the device disclosed in U.S. Pat. No. 4,226,111 is adapted to apply a constant peening force on the metal being worked due to the spring loading of the peening element. The force applied by the spring cannot be varied.

Other prior devices for straightening the curvature in metal objects are disclosed in U.S. Pat. Nos. 3,986,380 and 2,486,844. Each of the patents also disclose peening devices which utilize a rounded tip, as contrasted to the chisel point of the present invention.

The method of the present invention employs the principle that repeated, manually variable high-frequency strikes or blows to a curved piece of hardened metal by a strike bolt having a chisel point against a work surface will straighten the curvature in the metal. The blows are applied to the inner side of the curvature.

The apparatus for carrying out this method is characterized by a pneumatically operated high speed air hammer which is manually and variably controlled, and which reciprocally drives a steel tipped chisel-pointed peening element. The air hammer and peening element are adjustably mounted on a support column to enable the apparatus to accept metal pieces of various sizes. A rigid table supports the workpiece in the path of movement of the strike bolt. A grooved support block is located on the table to hold bar stock in place beneath the peening element and is removably attached to the work table. The grooved support block can be detached when sheet stock is being worked by the apparatus. The manual control of the air hammer permits the operator to selectively regulate the force of the air hammer depending on the cross-section of the piece being worked. Gauges are located on the work surface to permit measuring the straightness of the worked pieces as the peening operation progresses.

The invention will be described in more detail with reference to the accompanying drawings, in which one preferred embodiment of an apparatus for straightening and inspecting hardened metal material is shown.

DETAILED DESCRIPTION OF THE PREFERRED EMBODIMENT

Figure 1:
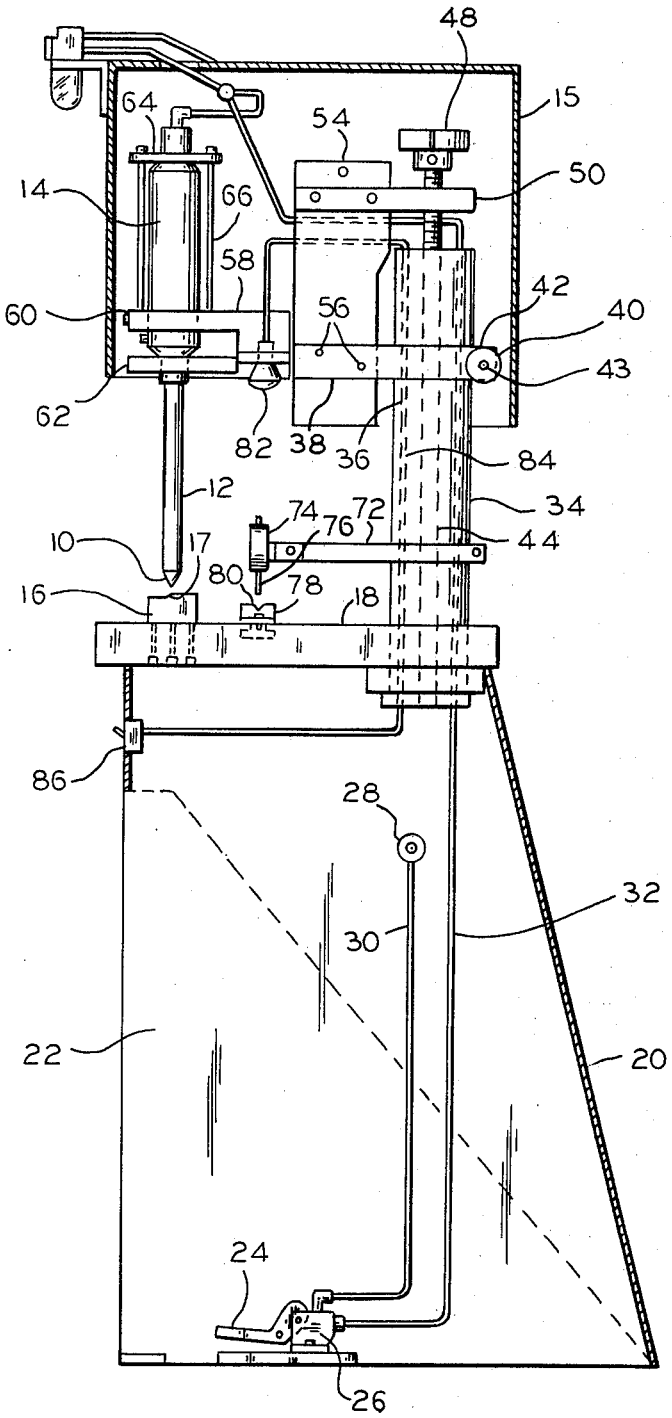
FIG. 1 is a side schematic view of the peen straightening machine of the present invention.
Figure 2:
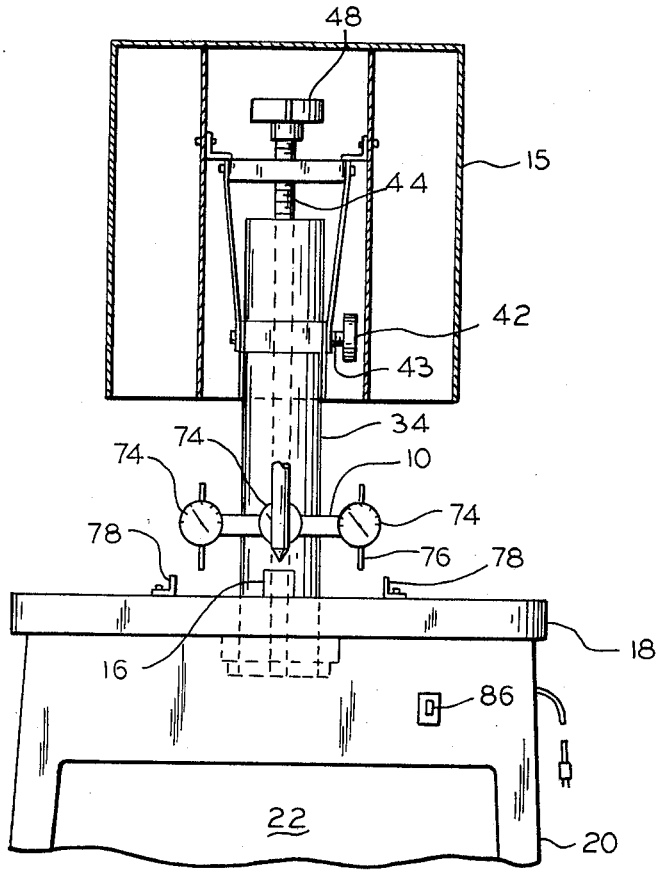
FIG. 2 is a front schematic view of the device illustrated in FIG. 1.

An elongated hardened metal workpiece to be straightened is identified by the reference numeral 10 in FIGS. 1 and 2. The curvature of the workpiece 10, which was caused by heat treating the metal, or by other mechanical processes applied to the metal, is shown exaggerated for illustrative purposes. Actual curvature is in the range of tenths of millimeters.

Referring to FIGS. 1 and 2, a peen chisel 12 is firmly held by an air hammer 14 disposed inside a housing 15. Peen chisel 12 has a pointed tip, preferably angled approximately fifteen degrees on either side of the tip. The workpiece 10, which is round in cross-section in the preferred embodiment is held on a support block 16 removably mounted on a flat, rigid support table 18. As seen in FIG. 1, support block 16 includes a grooved portion 17 to locate workpiece 10 beneath peen chisel 12 and prevent the workpiece 10 from slipping while it is being straightened. The disclosed apparatus can also be used to straighten hardened sheet metal or steel parts, in which instance support block 16 is removed from support table 18.

Support table 18 preferably comprises a flat, hard steel surface, with sufficient strength to withstand the stress caused by peen chisel 12 repeatedly striking workpiece 10. Table 18 is mounted on a base 20 which comprises a cut-out portion 22 facing the front of the apparatus, such that an operator's foot may be placed beneath support table 18 to actuate a floor-mounted foot pedal 24. Pedal 24, when depressed by the operator, actuates a pnuematic valve 26 which is attached to a source 28 of air under pressure through a hose 30, and to air hammer 14 by means of hose 32. Valve 26 is infinitely variable whereby the amount of air pressure delivered to air hammer 14 can be selectively raised or lowered by the operator through proper positioning of pedal 24. The force and frequency of the reciprocal strokes of the air hammer is varied in accordance with the amount of air pressure delivered by valve 26.

A hollow cylindrical column 34 is mounted to and extends upward from the rear of support table 18, as viewed by the operator. Slidably mounted on the exterior surface of column 34 is a column lock member 36 which has an outward extending mount arm 38 and a fork-like locking portion 40. A manually operated nob 42 is connected to a screw 43 which extends across fork-like locking portion 40 of column lock member 36, whereby column lock member 36 can be locked at any height on column 34 by rotating knob 42 and tightening column lock member 36.

Figure 3:
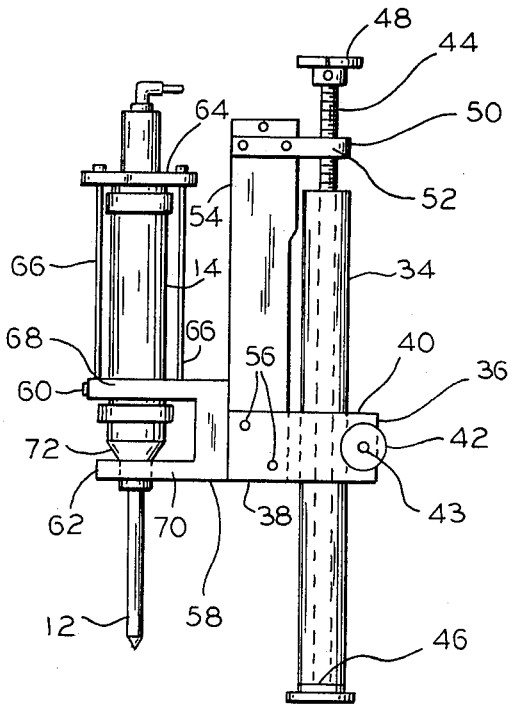
FIG. 3 is a detail side view of the adjustable air hammer support for the peen chisel comprising the present invention.

As best seen in FIGS. 1 and 3, a threaded shaft 44 extends vertically through column 34, and rests on the base 46 of column 34 (FIG. 3). A nob 48 is fixed to the top of shaft 44 to provide for manual rotation of shaft 44. Bracket 50 which includes a threaded aperture 52 therethrough, extends laterally from shaft 44, and is fixed to a vertically extending adjusting rail 54. The lower portion of rail 54 is fixed to mount arm 38 of by means of bolts 56.

The external threads on shaft 44 engage mating internal threads in aperture 52, whereby rotation of knob 48 will result in vertical movement of rail 54 and mount arm 38 when column lock 36 is in its un-locked position. When mount arm 38 is in its proper position, as will be explained in more detail hereinafter, knob 42 is rotated to tighten locking portion 40, and mount arm 38 is rigidly fixed in its vertical position on column 34.

Attached to mount arm 38 is an air hammer mounting bracket 58 having an upper arm 60 and a lower arm 62. A bracket 64 is fixed to upper arm 60 by means of support rods 66. Air hammer 14 is supported by and extends downward from bracket 64, and through apertures 68 and 70 in arms 60 and 62 of mounting bracket 58. Air hammer 14 is rigidly held in aperture 68, and extends freely through aperture 70 due to the tapered end 72 of air hammer 14.

Peen chisel 12 is firmly held by air hammer 14, and is adapted for repeated, high speed reciprocal movement under the control of air hammer 14. The bottom of peen chisel 12 is disposed immediately above support block 16.

The apparatus of the present invention includes means to check the run out or deformity of the workpiece 10 as it is being straightened by peen chisel 12. To this end, an indicator support arm 72 (FIG. 1) is fixed to column 34 and extends toward, but stops short of, the path of peen chisel 12. In the preferred embodiment, a plurality of depth-type dial indicators 74 are mounted in line on the forward portion of support arm 72. Each indicator includes a vertically movable, spring loaded rod 76 extending downward from the dial indicator, whereby all three rods 76 are aligned. A pair of V-blocks 78 are mounted on table 10 just to the outside of the two outermost dial indicators 74, and are so positioned that the V-grooves 80 in the blocks 78 are directly aligned with all three spring loaded rods 76.

The straightness of workpiece 10 after being subjected to the chisel peening process, to be described, is checked by placing the workpiece between, and supported by, V-blocks 78. This will force rods 76 upward against the bias of the springs tending to force the rods downward, and rotate each dial corresponding to the amount of vertical rise of each rod 76. When the workpiece 10 is straight, each rod 76 will have been moved upward an equal increment, and each of the dial indicators 74 will give the same reading. If the workpiece 10 is not straight, the readings produced by dial indicators 74 will not be in agreement.

To assist the operator, a light 82 is provided over support table 18 to illuminate the work area. Light 82 is connected by wire 84 to a switch 86, which is manually controlled by the operator.

Figure 4:
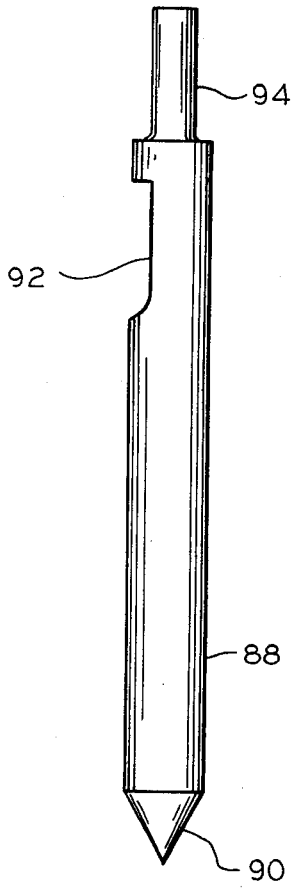
FIG. 4 is a detail view of the peen chisel forming part of the present invention.

Referring to FIG. 4, the details of peen chisel 12 are illustrated. Peen chisel 12 comprises an elongated shaft 88, terminating at its lower extremity in a chisel point 90 having an angle of 15° on each side. The upper portion of shaft 88 includes an indented portion 92 and a shank 94, which are used to mount and align peen chisel 12 in air hammer 14.

In operation, referring to FIGS. 1 and 2, a hardened metal workpiece 10 to be straightened is placed on support block 16 beneath peen chisel 12 and air hammer 14. For purposes of illustration, workpiece 10 is shown as a piece of round bar stock which is placed against cut-out portion 17 on block 16 to insure proper positioning. If the workpiece 10 is a substantially flat piece of hardened metal stock, block 16 is removed from support table 18, and the flat metal stock is placed directly on support table 18 beneath peen chisel 12.

The vertical position of peen chisel 12 and air hammer 14 is next adjusted manually by the operator, in accordance with the desired stroke of peen chisel 12 and the thickness of the workpiece 10. To this end, nob 42 is rotated to loosen column lock 36 whereby mount arm 38 is free to be vertically re-positioned on column 34. Next, nob 48 at the top of threaded shaft 44 is turned by the operator, thereby rotating shaft 44.

The external threads on shaft 44 engage mating internal threads in aperture 52 of bracket 50 (FIG. 3), driving bracket 50, adjusting rail 54, and air hammer mounting bracket 58 in a vertical direction along column 34. As mounting bracket 58 moves, the location of air hammer 14 and peen chisel 12 above workpiece 10 can be precisely established. Nob 42 is next rotated to tighten column lock 36 and secure air hammer 14 and peen chisel 12 in its desired position.

The apparatus is now ready to commence the straightening operation on workpiece 10. The operator depresses foot pedal 24 which regulates valve 26 and the amount of air pressure transmitted from source 28, through hoses 30 and 32, to air hammer 14. Air hammer 14 reciprocally drives peen chisel 12 to repeatedly strike workpiece 10. By varying the degree of depression of foot pedal 24, the operator can regulate the force or frequency of the stroke delivered by peen chisel 12 to any desired level. The force or frequency of this stroke is a function of the cross section and hardness of workpiece 10. Thus, for harder or thicker metal workpieces, a stronger peening stroke can be delivered by the disclosed apparatus. The series of repeated strokes applied to the inside curvature of workpiece 10 results in straightening the curvature of the workpiece 10.

After peening the workpiece 10 for a given period of time, which the operator establishes by experience and by visual observation of the effect of the peening operation, the workpiece 10 is removed from beneath peen chisel 12 and placed across V-blocks 78. Spring loaded rods 76 rest on top of workpiece 10, and dial indicators 74 will register any difference in height between the portions of the workpiece beneath the dial indicators 74. If the indicators 74 show that the workpiece 10 requires further straightening, the workpiece 10 is replaced on support block 16, and the above-described peening and measuring process is repeated until the workpiece 10 is straightened to specification.

Since the metal pieces used in the aforedescribed process are hard all the way through, any chisel marks formed in the metal are slight and very little grinding is required to smooth the surface after completion of the peening process.

It will be apparent from the foregoing description that the peen straightening method and apparatus of the present invention provide a number of advantages, some of which have been described above, and others of which are inherent in the invention.

Also, it will be apparent that modifications can be made to the method and apparatus of the present invention without departing from the teachings of the present invention. Accordingly, the scope of the invention is only to be limited as necessitated by the accompanying claims.

I claim:

1. An apparatus for straightening the curvature in a hardened metal workpiece comprising:

a rigid support surface for supporting said workpiece;

a source of air under pressure;

pneumatically operated peen chisel means disposed above said support surface including an air hammer having a peen chisel mounted therein for repeated reciprocal movement by said air hammer for repeatedly striking said workpiece as said workpiece is supported in the path of said peen chisel, said peen chisel located above said support surface and said workpiece, and said source of air pressure being operably connected to said air hammer;

control means operably connected between said source of air pressure and said air hammer to selectively and infinitely vary the amount of air under pressure delivered to said air hammer;

a vertical column mounted on said support surface;

mounting bracket means disposed for vertical movement along the length of said vertical column;

said air hammer supported by said mounting bracket means;

adjusting means operably connected between said vertical column and said mounting bracket means to vary the position of said mounting bracket means and said air hammer relative to said vertical column;

said adjusting means comprising a shaft having external threads extending along the length of said column and mounted for rotation relative to said support surface;

means to rotate said externally threaded shaft;

additional bracket means having an internally threaded aperture therein whereby said externally threaded shaft extends through said aperture and said threads to form a driving relationship;

said additional bracket means fixed to adjusting rail means extending partially along the length of said column;

said adjusting rail means fixed to said mounting bracket means whereby rotation of said externally threaded shaft moves said air hammer in a vertical direction.

2. The apparatus of claim 1 wherein said control means comprises a manually operable, infinitely variable valve connected between said air pressure source and said air hammer, whereby the frequency of said peen chisel as it strikes said workpiece is selectively controlled by said control means.

3. The apparatus of claim 1 wherein said peen chisel includes a relatively sharp chisel tip.

4. The apparatus of claim 3 wherein said chisel tip has an angle of 15° on either side.

5. The apparatus of claim 1 including a plurality of dial indicators linearly supported above said support surface, a pair of V-blocks fixed to said support surface in line with said dial indicators, whereby said dial indicators are adapted to measure the straightness of a workpiece extended between said V-blocks.

* * * * *